United States Patent [19]

Bosniac

[11] Patent Number: 4,785,715

[45] Date of Patent: Nov. 22, 1988

[54] HYDRAULIC CONTROL MEANS FOR A SWEEPING ROLLER HELD BY TWO CYLINDERS IN A SWEEPING MACHINE

[75] Inventor: Deian Bosniac, Lohr am Main, Fed. Rep. of Germany

[73] Assignee: Mannesmann Rexroth GmbH, Lohr am Main, Fed. Rep. of Germany

[21] Appl. No.: 80,952

[22] Filed: Jul. 31, 1987

[30] Foreign Application Priority Data

Aug. 1, 1986 [DE] Fed. Rep. of Germany ..... 3626201

[51] Int. Cl.[4] ..... F15B 11/00; F15B 13/00

[52] U.S. Cl. ..... 91/514; 91/518; 91/519; 91/532; 15/82

[58] Field of Search ..... 91/511, 514, 516, 517, 91/518, 519, 532, 361, 459; 15/82, 83, 84, 85, 86

[56] References Cited

U.S. PATENT DOCUMENTS 3,037,226 6/1962 Schmidt et al. ..... 15/82
3,616,477 11/1971 Larson ..... 15/82
3,760,688 9/1973 Dummer ..... 91/532
4,328,603 5/1982 Dickson et al. ..... 15/84
4,349,305 9/1982 Wynn et al. ..... 91/516 X
4,615,260 10/1986 Takagi et al. ..... 92/92

FOREIGN PATENT DOCUMENTS 2821627 11/1979 Fed. Rep. of Germany .
3107840 8/1985 Fed. Rep. of Germany .

*Primary Examiner*—Robert E. Garrett
*Assistant Examiner*—Mark A. Williamson
*Attorney, Agent, or Firm*—Harness, Dickey & Pierce

[57] ABSTRACT

The sweeping roller of a sweeping machine is held on the ground in sweeping operation by two hydraulic cylinders in such a manner that the degree of wear is small. For this purpose in each cylinder a static and different holding pressure must be set. The higher pressure is set at a pressure-limiting valve and the lower pressure at the series circuit parallel thereto of a nozzle with an adjustable throttle.

5 Claims, 1 Drawing Sheet

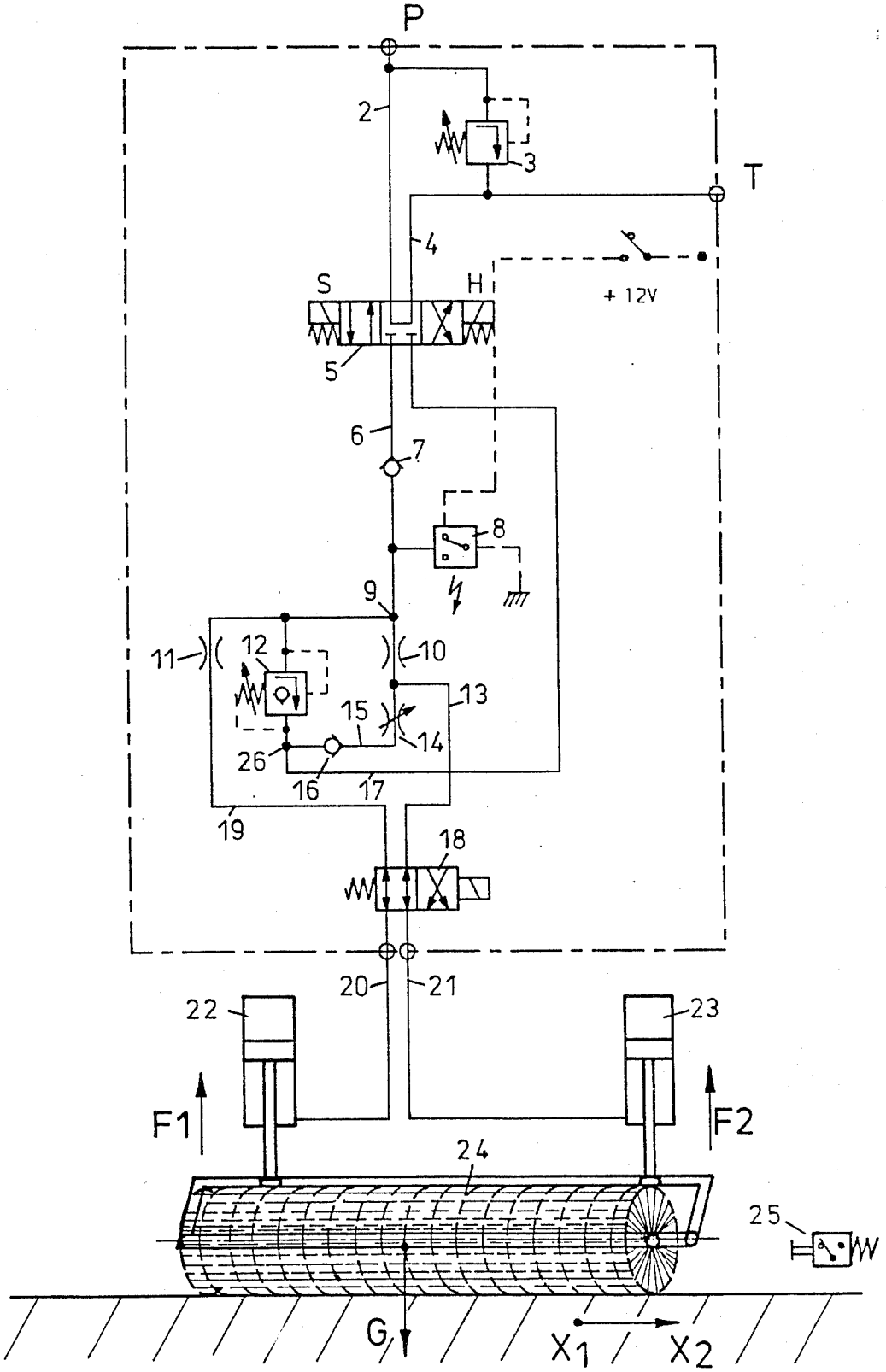
P
T
2
3
4
S
H
+ 12V
5
6
7
8
9
10
11
12
13
14
15
16
17
18
19
20
21
22
23
24
25
26
F1
F2
G
X1
X2

HYDRAULIC CONTROL MEANS FOR A SWEEPING ROLLER HELD BY TWO CYLINDERS IN A SWEEPING MACHINE

BACKGROUND OF THE INVENTION

The invention relates to a hydraulic control means for a sweeping roller held by two cylinders in a sweeping machine.

In sweeping machines the aim is to keep the degree of wear of the sweeping rollers as low as possible and consequently excessive pressing of the sweeping roller onto the ground is to be avoided. In sweeping operation in which the sweeping roller bears on the ground due to the offset holding structure of the sweeping roller unequal holding forces arise. If the sweeping roller is held by two hydraulic cylinders in sweeping operation constant but different pressures must be adjusted in the cylinders in order to guide the sweeping roller satisfactorily and to avoid excessive or one-sided wear.

The problem underlying the invention resides in providing a hydraulic holding and guide means of a sweeping roller which makes it possible in simple manner to maintain different constant pressures in the cylinders holding and guiding the sweeping roller.

SUMMARY OF THE INVENTION

Said problem is solved according to the invention by the features set forth in claim 1. Advantageous further developments will be apparent from the subsidiary claims.

According to the invention it is thus possible in simple manner to set the higher pressure at the pressure-limiting valve and the lower pressure at the half bridge consisting of the nozzle and throttle by adjusting the throttle. The distributing circuit according to the invention generates only a static pressure in the holding cylinders of the sweeping roller which is not sufficient to raise the sweeping roller. According to the invention the application force of the sweeping roller can be adjusted by setting the pressures so that the sweeping roller has an optimum degree of wear.

BRIEF DESCRIPTION OF THE DRAWING

An example of embodiment of the invention will be explained in detail hereinafter with the aid of the single FIGURE in which a control means is schematically illustrated.

DETAILED DESCRIPTION OF THE PREFERRED EMBODIMENT

A fluid source not shown, for example a gear pump, delivers via the connection P fluid into a pressure line 2 which is protected via a pressure-limiting valve 3. The pressure line 2 and a line or conduit 4 leading to a tank T are connected to a directional control valve 5 which has a pair of actuating electro magnets S and H.

For sweeping operation the magnet S of the directional control valve 5 is energized so that the pressure line 2 is connected to the line 6 and fluid passes via the check valve 7 to the inlet 9 of a distributing circuit. The distributing circuit consists of a pressure-limiting valve 12 and a series circuit of a nozzle 10 and an adjustable throttle 14. This series circuit lies in parallel with the pressure-limiting valve. The outlet 26 of the distributing circuit is connected via a conduit 17 in the position described of the directional control valve 5 to the conduit 4 leading to the tank T. In the connecting line 15 between the throttle 14 and the outlet 26 a check valve 16 is disposed.

In a conduit 19 connected via a nozzle 11 to the inlet 9 the inlet-side higher pressure adjustable at the pressure-limiting valve 12 exists. Downstream of the nozzle 10 and upstream of the throttle 14 the conduit 13 is connected in which the lower pressure adjustable by the variable throttle 14 exists.

Via a directional control valve 18 the conduits 19 and 13 are connected to the conduits 20 and 21 leading to the singly acting cylinders 22 and 23. By switching over the directional control valve 18 the pressures adjusted in the cylinders can be reversed.

The cylinders 22 and 23 each hold the sweeping roller 24 at different distances from the ends of the roller 24. The suspension of the sweeping roller is not shown in detail because it is not essential to the invention. In any case, in normal sweeping operation the holding forces F1 and F2 applied by the cylinders are different due to the different distances the cylinders are spaced from the respective roller ends and in the example of embodiment chosen the force F1 is to be greater than the force F2.

The pressure in the conduit 20 for the cylinder 22 which generates the force F1 is set at the pressure-limiting valve 12. Since this pressure or the force exerted by the cylinder 22 is not sufficient to raise the sweeping roller, i.e. only a static pressure is adjusted in the cylinder 22, no fluid flows through the nozzle 11.

The amount delivered by the pump is on the contrary conducted via the pressure-limiting valve 12 and the half bridge 10, 14 into the conduit 17 and via the directional control valve 5 back into the tank T.

The setting of the lower pressure which is adjusted in the cylinder 23 is by adjustment of the throttle 14. With the nozzle 10 and the throttle 14 a quantity-independent pressure may be generated because the pressure in the conduit 13 depends only on the setting of the throttle 14, as can be mathematically demonstrated.

Thus, a static pressure also arises in the cylinder 23 which is smaller than the pressure in the cylinder 22. The application force is calculated on the weight of the sweeping roller G minus the sum of the holding forces F1 and F2. Since the holding forces F1 and F2 can be exactly adapted to the weight of the sweeping roller the degree of wear of the sweeping roller is optimized.

In sweeping machines of the type in question here the sweeping roller 24 can be displaced in the axial direction to enable sweeping to be carried out also laterally outside the vehicle. If the sweeping roller 24 is displaced for example in the direction x2 the new end position is detected by an electrical limit switch 25 via which the directional control valve 18 is switched so that the pressures set at the pressure-limiting valve 12 and at the throttle 14 in the cylinders 22 and 23 are reversed due to the reversal of the distance between the cylinders 22 and 23 and the respective ends of the roller 24.

Due to the design of the directional control valve 18 a small amount of leakage continuously flows from the conduit of higher pressure over into the conduit of lower pressure. In the present circuit this cannot lead to an undesirable buildup of pressure in the conduit of lower pressure because said conduit is connected via the throttle 14 to the tank.

In normal travelling operation of the sweeping machine the sweeping roller is to be raised from the ground. For this purpose the directional control valve 5 is switched over by energizing the magnet H so that the fluid delivered by the pump is conducted through the conduits 17 to the outlet 26 of the distributing circuit. The lifting pressure is substantially higher than the pressure set at the pressure-limiting valve 12. The fluid passes from the conduit 17 only through the check valve incorporated into the pressure-limiting valve 12 to the outlet 9, the check valves 7 and 16 being in a blocking position.

Thus, the fluid from the inlet 9 can flow only via the nozzles 10 and 11 to the conduits 13 and 19 and thus to the cylinders 22 and 23. The nozzles 10 and 11 have the same cross-section so that the cylinders 22 and 23 are supplied with identical amounts and consequently the pistons of the cylinders move with the same velocity. Pressure builds up in the cylinders until the resultant force F1 plus F2 is greater than the weight G of the sweeping roller so that the latter is raised from the ground. Once the end position is reached the pressure increases up to the value set at a pressure limit switch 8 which then interrupts the power supply to the magnet H of the directional control valve 5 so that the spring-centered piston of the directional control valve 5 is pushed back into the neutral position. As a result, the amount of oil delivered from the fluid source is conducted pressureless to the tank and the power loss in travelling operation is kept low.

I claim:

1. Hydraulic control means for a sweeping roller held by two cylinders in a sweeping machine spaced at different distances from the roller ends, characterized in that between a fluid source and a tank a distributing circuit is provided which consists of a pressure-limiting valve and parallel to said pressure-limiting valve a series circuit of a nozzle and an adjustable throttle, one of said cylinders being connected to the inlet of the distributing circuit and the other of said cylinders being connected between said nozzle and such adjustable throttle, each cylinder being supplied with a respective constant and different pressure from the pressure-limiting valve and the throttle respectively.

2. Control means according to claim 1, characterized in that between the fluid source and the distributing circuit a directional control valve is disposed which in a first position connects the fluid source to the inlet of the distributing circuit and the outlet to the tank and which in a second position for raising the sweeping roller interchanges these connections, the admission of equal pressure to both cylinders taking place through the opening of a check valve bridging the pressure-limiting valve.

3. Control means according to claim 2, characterized in that in the conduit leading from an inlet-side connection of the pressure-limiting valve to the one cylinder has positioned therein a nozzle whose cross-section is equal to the nozzle in the series circuit.

4. Control means according to claim 1, characterized in that between the distributing circuit and the cylinders a directional control valve is provided with which the pressures adjusted in the cylinders can be reversed.

5. Control means according to claim 4, wherein the sweeping roller is laterally displaceable and characterized in that the switchover of the directional control valve takes place automatically in dependence upon the lateral position of the sweeping roller.

* * * * *